US005163383A

United States Patent [19]

Roy

[11] Patent Number: 5,163,383

[45] Date of Patent: Nov. 17, 1992

[54] SHEEP HANDLING SYSTEM

[76] Inventor: Duane L. Roy, 5520 Monty La., Lolo, Mont. 59847

[21] Appl. No.: 764,361

[22] Filed: Sep. 23, 1991

[51] Int. Cl.[5] ..... A61D 3/00

[52] U.S. Cl. ..... 119/98

[58] Field of Search ..... 119/96, 98, 103; 269/322, 323

[56] References Cited

U.S. PATENT DOCUMENTS 2,306,031 12/1942 Anderson et al. ..... 269/323
2,693,987 11/1954 Wall et al. ..... 269/323
2,960,966 11/1960 Monson ..... 119/103

FOREIGN PATENT DOCUMENTS 211283 6/1957 Australia ..... 119/98

*Primary Examiner*—Gene Mancene
*Assistant Examiner*—Thomas Price
*Attorney, Agent, or Firm*—Harry M. Cross, Jr.

[57] ABSTRACT

The present invention provides apparatus for inverting sheep into a reclined position for examination and treatment. The apparatus provides a holding bed that can be positioned to a first position to receive a sheep that is being inverted by the technique used by sheep-shearers, and can then be positioned to a second position which places the sheep in a reclined position on its rump and back with its feet pointing upward. The method of inverting the sheep into the bed, when the bed is located at its first position, is non-threatening to the sheep and the sheep ends up laying in the bed without struggling. When the bed is then shifted to its second, examining and treating, position, the sheep feels secure, unthreatened, and therefore reclines comparatively comfortably without struggling. The apparatus of this invention enables the operator to stand along side of the bed and take a sheep, passing in front of the bed, and turn the sheep as though he were going to position the it into a sheep-shearing position against his legs and knees, but rather turns it into that position into the bed rather than against his own legs and knees. This sheep-turning involves lifting the front end of the sheep sufficiently to unweight the sheep's front end, and turning the sheep, by pivoting the sheep about the hind foot nearest the operator, into the bed. As the sheep is pivoted upward and around its "near" hind foot, the haunch of its "near" hind leg catches the edge of the bed, causing the sheep to promptly sit down onto the end of the bed. Upon sitting down onto the end of the bed, the sheep is rolled by the operator into the bed and the bed is then positioned to its second position. The sheep then assumes a reclining position with its rump resting against the end of the bed and with its back laying along the bed. When the bed is in its second, examining and treating, position, the bed is itself inclined toward the end so that the sheep's rump will be supported by the end of the bed while it reclines in the bed.

16 Claims, 6 Drawing Sheets

FIG. 4
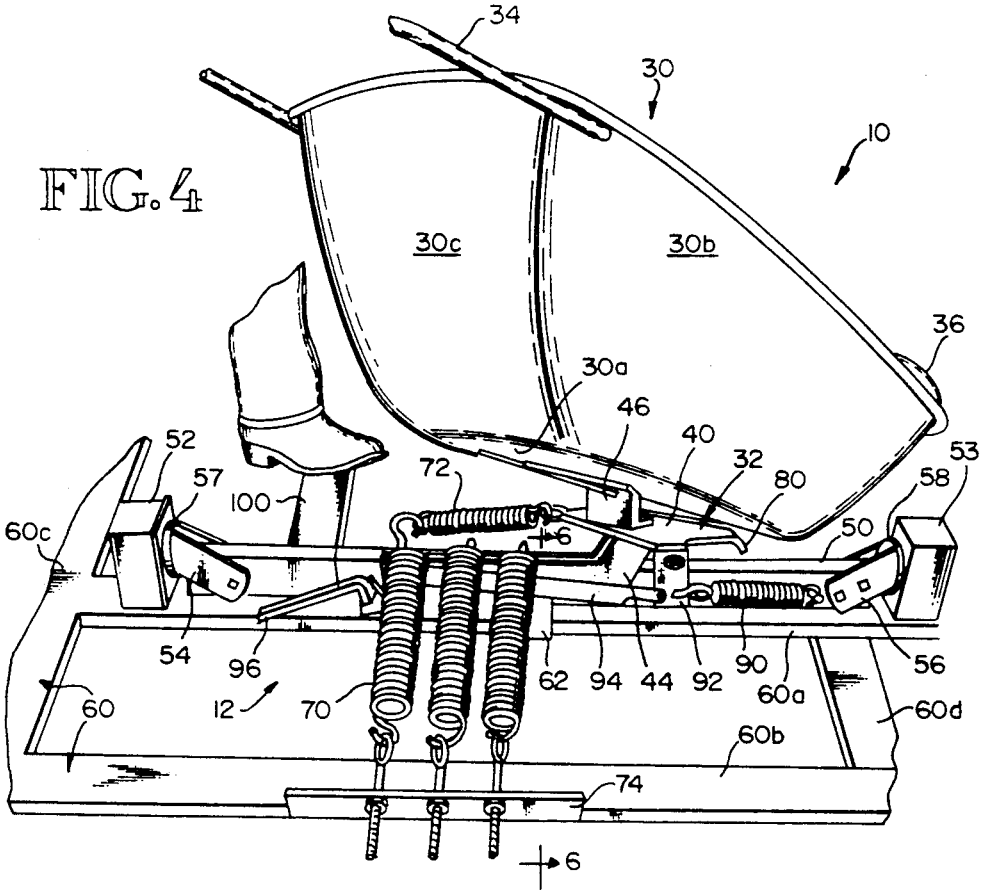
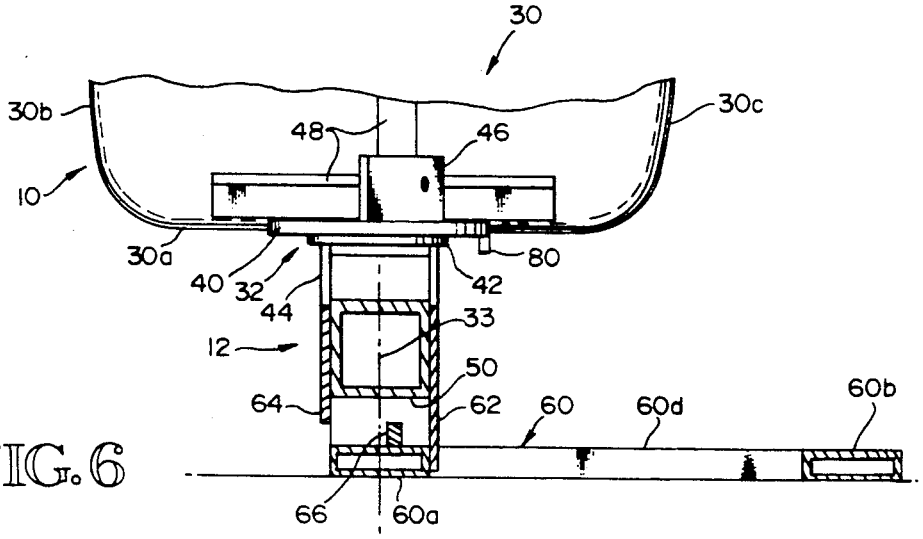
FIG. 6

SHEEP HANDLING SYSTEM

FIELD OF THE INVENTION

This invention relates to systems for handling sheep, and more particularly to sheep handling systems intended to hold and maintain sheep in a suitable position for examination and treatment.

BACKGROUND OF THE INVENTION

When sheep are examined for foot treatment, veterinary treatment, and the like, they must be inverted onto their backs or rumps and held in that position for the duration of the examination and treatment. Two men can accomplish this task by one man turning a sheep over from a standing position onto its rump with its back resting between and against the handler's legs and knees. Then the second man can examine and treat the sheep while the first man, standing behind the sheep, holds on to its front legs and restrains it from moving about. It is well known that sheep will accept being held in that position without fighting or struggling; and, in fact, it is that position that sheep-shearers invert sheep into before shearing them.

Mechanical devices have been proposed to invert sheep into a suitable position for examination and treatment, but none have been adequate to effect inversion of sheep into a position that is safe for the sheep and safe for the operator of the device. For example, cattle-type squeezes have been down-sized for use with sheep and designed to squeeze a standing sheep to immobility so that the squeeze can be rotated 90 degrees to turn a restrained sheep onto its side for examination and treatment. However, when sheep are squeezed in such a device and then turned onto their sides, they immediately will try to struggle free. Their sides, bearing a thick layer of wool, are not suitably confined by the squeeze and it is relatively easy for them to struggle to the point of injuring themselves. Moreover, squeezes of this type do not work well with horned rams.

Other types of sheep handling devices have been proposed which involve inverting a sheep into a reclining position by tipping the sheep vertically upward and backward over its hind legs onto its back, either flat on its back or to a reclined position where the sheep would be resting on its rump and its back. This type of device is also unsuitable because sheep will struggle as they are being tipped up and backward and begin to lose footing with their hind feet. Also, this type or device requires the expenditure of enormous energy on the part of the handler to lift the sheep upward and force them backward into the device.

Modifications of the just-described device include means attempting to enable a sheep to be lifted upward off its front legs and seated into a basket and then tipped backward, off its hind feet, onto its back to a reclined position within the basket. This modified device, however, still does not eliminate the tendency for sheep to struggle as they begin to lose the footing of their hind feet; and excessive energy is still required on the part of the operator in forcing sheep upward and backward.

SUMMARY OF THE INVENTION

The present invention provides apparatus for inverting sheep into a reclined position for examination and treatment. The apparatus provides a holding bed that can be positioned to a first position to receive a sheep that is being inverted by the technique used by sheep-shearers, and can then be positioned to a second position which places the sheep in a reclined position on its rump and back with its feet pointing upward. The method of inverting the sheep into the bed, when the bed is located at its first position, is non-threatening to the sheep and the sheep ends up laying in the bed without struggling. When the bed is then shifted to its second, examining and treating, position, the sheep feels secure, unthreatened, and therefore reclines comparatively comfortably without struggling. The apparatus of this invention enables the operator to stand along side of the bed and take a sheep, passing in front of the bed, and turn the sheep as though he were going to position the it into a sheep-shearing position against his legs and knees, but rather turns it into that position into the bed rather than against his own legs and knees. This sheep-turning involves lifting the front end of the sheep sufficiently to unweight the sheep's front end, and turning the sheep, by pivoting the sheep about the hind foot nearest the operator, into the bed. As the sheep is pivoted upward and around its "near" hind foot, the haunch of its "near" hind leg catches the edge of the bed, causing the sheep to promptly sit down onto the end of the bed. Upon sitting down onto the end of the bed, the sheep is rolled by the operator into the bed and the bed is then positioned to its second position. The sheep then assumes a reclining position with its rump resting against the end of the bed and with its back laying along the bed. When the bed is in its second, examining and treating, position, the bed is itself inclined toward the end so that the sheep's rump will be supported by the end of the bed while it reclines in the bed.

BRIEF DESCRIPTION OF THE DRAWINGS

FIG. 4 is a partial view in elevation of the sheep-holding bed and the bed-positioning mechanism, the bed being shown in its sheep-loading/unloading position;

FIG. 6 is a section view taken along the lines 6—6 of FIG. 4;

DETAILED DESCRIPTION OF THE INVENTION

Figure 2:
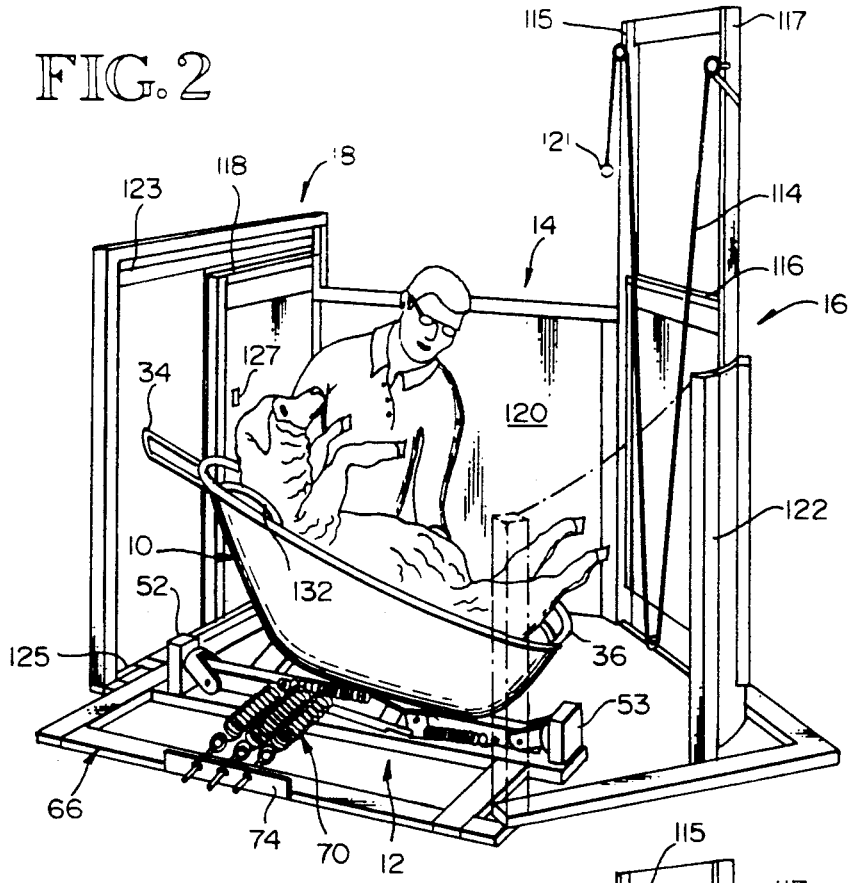
FIG. 2 is another perspective view of the apparatus of this invention with the operator-handler shown alongside the sheep-containing bed with the bed positioned to place the sheep into an examining and treating position.

The apparatus of this invention comprises a sheep-holding means 10 and a sheep holder positioning and mounting means 12, positioned within an examining and treating compartment 14. The sheep-holding means 10 and positioning and mounting means 12 are preferably located within a compartment 14 since compartment 14 is arranged to be placed in a sheep run to accept sheep through a doorway 16 from the sheep run and to exit sheep through a doorway 18 back to the sheep run or into a corral or field. However, sheep-holding means 10 and positioning and mounting means 12 are designed to be used in any environment, within or without an enclosure. Within compartment 14, space is provided for both a sheep and an operator-handler to handle a sheep and to operate the apparatus, and to examine and treat a sheep.

Figure 1:
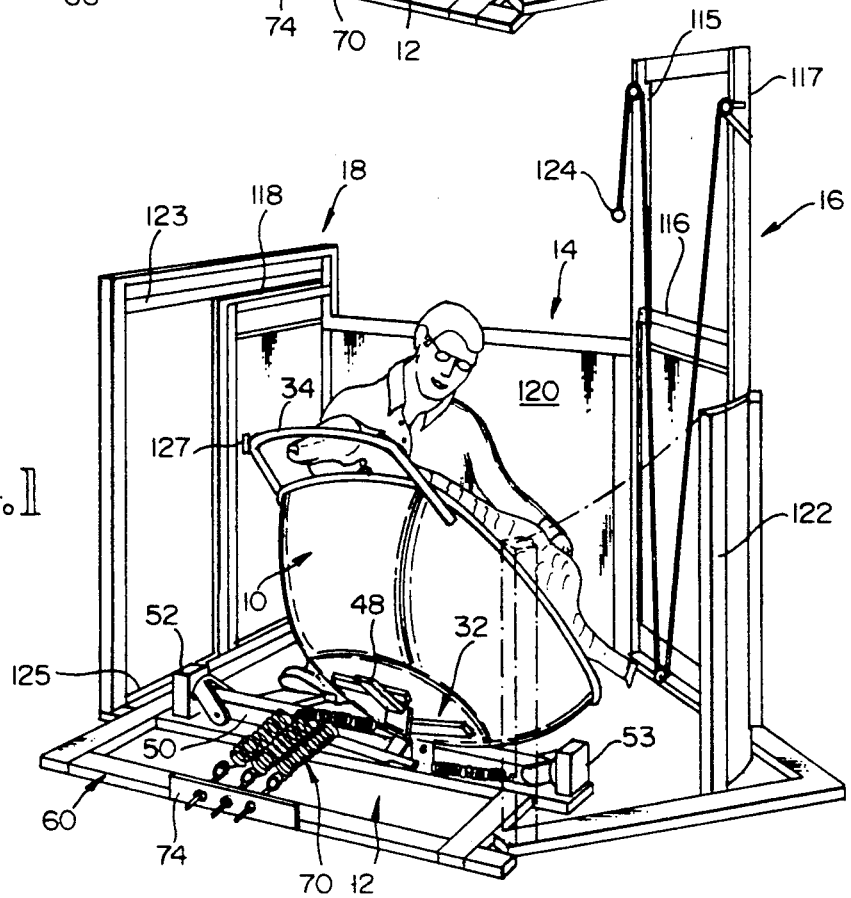
FIG. 1 is a perspective view of the apparatus of this invention with an operator-handler shown in the final stage of loading a sheep into the holding bed positioned in its first, loading/unloading position.

The sheep-holding means 10 comprises a bed or pan 30 mounted from below by a turntable 32. Bed 30 comprises a bottom wall 30*a*, side walls 30*b* extending upward and outward from the bottom wall, a top wall 30*c* connecting the two side walls at the head of the bed, and an end wall 30*d* connecting the two side walls at the end, or foot, of the bed. Top wall 30*c* and end wall 30*d* extend upward and outward from the bottom wall at obtuse angles with respect to the plane of the bottom wall. The turntable 32 is rotatable about a normally-vertical axis 33 (see FIG. 6) and bed 30 is mounted to the turntable at an acute angle with respect to the axis of rotation 33. Consequently, when bed 30 is positioned in its normal, upright position, the bed bottom 30*a* is inclined, from top to end, toward the ground at an acute angle, preferably of about 45 degrees. This normally upright position is shown in FIG. 2, in contrast to the tilted-down position shown in FIG. 1. An operator-assist handle 34 is mounted to top wall 30*c* and extends outward therefrom in a plane that is generally parallel to the bed bottom 30*a*. A lip 36 is mounted to the top of end wall 30*d* and extends outward therefrom in the same plane as the end wall to provide an end extension for end wall 30*d*, thereby extending the effective length of end wall 30*d* beyond the top rails of the adjacent side walls 30*b*, as shown in FIGS. 2 and 4.

Turntable 32 comprises a flat plate 40, a swivel bearing assembly 42 attached to the underside of plate 40, and a mounting bracket 44 that straddles a shaft 50 and mounts bearing assembly 42 to shaft 50. Mounting bracket 44 positions bearing assembly 42 and plate 40 above and centered over shaft 50 as shown in FIGS. 4 and 6. The bottom wall 30*a* of bed 30 is positioned above plate 40 and is attached to plate 40 and is positioned at the aforementioned acute angle by means of a wedge member 46 placed between bottom wall 30*a* and plate 40. The bottom wall 30*a* may be suitably reinforced by cross-strapping 48, with the plate 40 and member 46 being attached to the cross-strapping 48.

The sheep holder positioning and mounting means 12 comprises the shaft 50, to which the holder bed or pan 30 is mounted, left and right upright shaft anchor blocks 52, 53, left and right shaft mounting brackets 54, 55, and left and right swivel bearings 57, 58. Swivel bearings 57, 58 mount brackets 54, 55 to their respective anchor blocks 52, 53 such that shaft 50 is horizontal and rotatable about a horizontal axis extending through the swivel bearings. Anchor blocks 52, 53 are mounted to a base frame 60 that comprises a rectangular framework including a pair of parallel side frame members 60*a* and 60*b* connected by end frame members 60*c* and 60*d*. Side frame member 60*a* underlies shaft 50 and mounts upright anchor blocks 52, 53 as shown in FIG. 4. Anchor blocks 52, 53 mount shaft 50 far enough above frame member 60*a* that shaft 50 will be able to rotate and still clear the frame member. Looking from the left toward the right (see FIG. 6) a stop plate 62 is attached to the inside of shaft 50 and extends downward to contact the inside of frame member 60*a* so as to limit clockwise rotation of shaft 50 so that shaft 50 cannot rotate clockwise beyond the normally upright position shown in FIG. 6. Also, looking from the left toward the right (see FIG. 6) a stop plate 64 is attached to the outside of shaft 50 and extends downward to contact the outside of a stop block 66. Stop block 64 is mounted to the top of frame member 60*a*, midway between the frame member side edges (see FIG. 6) so as to limit counterclockwise rotation of shaft 50 so that shaft 50 cannot rotate counterclockwise beyond about 35 degrees from the normally upright position shown in FIG. 6.

Positioning and mounting means 12 further comprises a set of restraining springs 70 and a return spring 72. Restraining spring set 70 comprises several coil springs (three being shown) which are anchored at one end to the top of shaft 50 and at the other end to a mounting bracket 74 that is attached to the outside of side frame member 60*b* as shown in FIG. 4. The ends attached to the mounting bracket 74 may be adjusted to increase or decrease the tension on spring set 70. Spring set 70 acts to rotate shaft 50 clockwise, when viewed as in FIG. 6, to position the holder bed or pan 30 in the upright position shown in FIG. 6 with stop plate 62 abutting the inside edge of side frame member 60*a*. Return spring 72 is anchored at one end to the top of shaft 50 and at the other end to plate 40, as shown in FIG. 6. Return spring is anchored to plate 40 at a location across the longitudinal axis of shaft 50 so that it tends to rotate holder bed or pan 30 clockwise when viewed as in FIG. 3. A stop lug 76 is attached to the underside of bed bottom wall 30*a* and hangs down far enough to contact the outer side of shaft 50 when spring 72 rotates the bed 30 to the position shown in FIG. 3, thereby limiting the clockwise rotation of bed 30.

Figure 7:
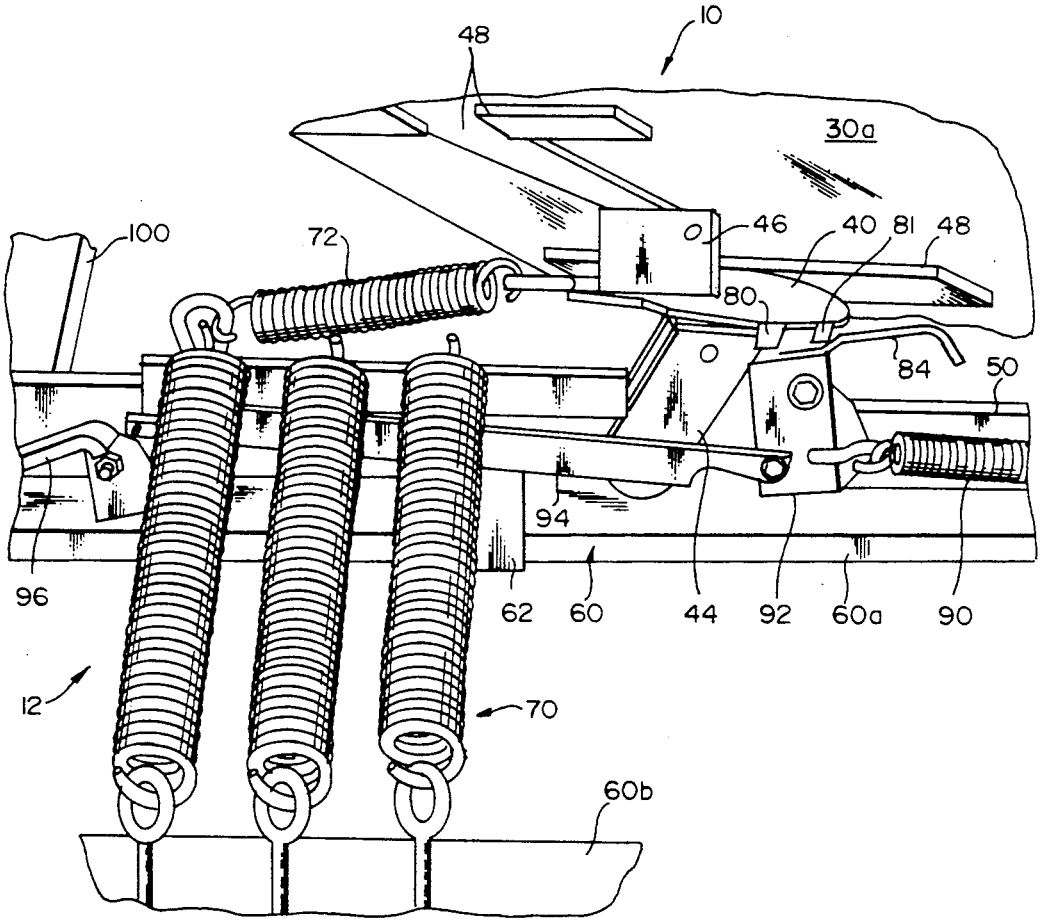
FIG. 7 is a still further-enlarged detail view of the bed-positioning mechanism showing the relationship of the underside of the bed with a bed-latching mechanism when the bed is positioned as shown in FIG. 2.
Figure 8:
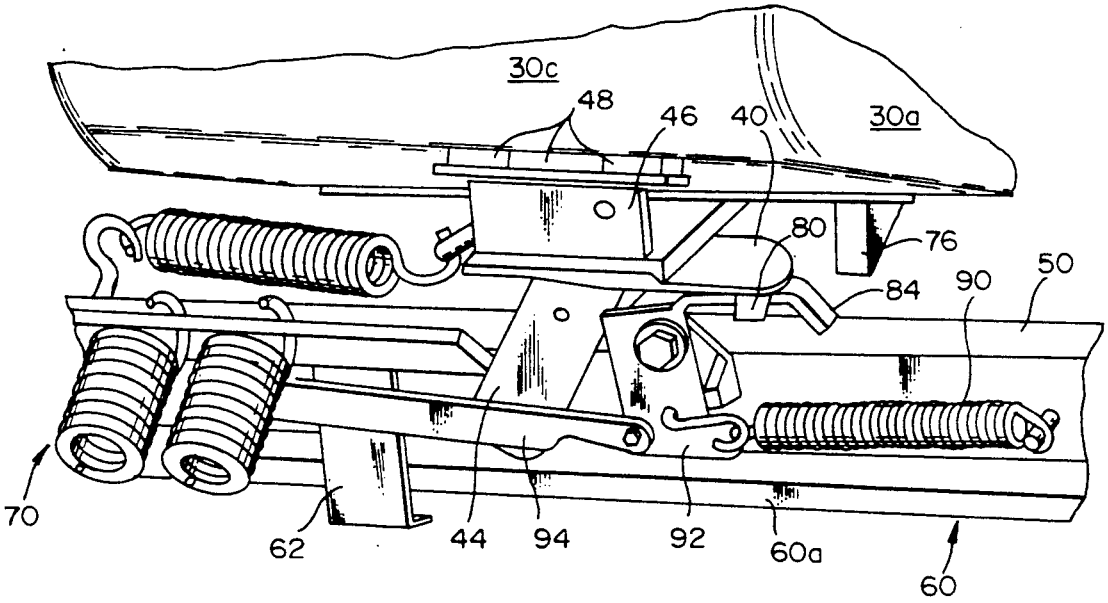
FIG. 8 is another detail view of the FIG. 7 structure, showing the relationship of the bed-latching mechanism and the underside of the bed when the bed is positioned in its examining and treating position.

Base frame 60 has a coplanar configuration broad enough to support holder means 10 and prevent it from tipping over when a sheep is loaded into bed 30, examined or treated therein, or unloaded therefrom. In order to further stabilize holder 10 when occupied by a sheep, and in order to also permit greater access to a sheep held therein, bed 30 is designed to be rotated about the normally vertical axis 33 by means of turntable 32. When a sheep is loaded into bed 30, bed 30 will be in the position shown in FIGS. 2 and 3. After loading the sheep, the system is designed for bed 30 to be rotated counterclockwise, when viewed as in FIG. 3, leftward until bed 30 is oriented perpendicularly to the longitudinal axis of shaft 50. In this perpendicular orientation, the longitudinal axis of the bed 30, from the top to the end will be aligned at right angles to the longitudinal axis of shaft 50. To rotate bed 30 from the position shown in FIG. 3 to the perpendicular position, the operator-handler will grasp handle 34 and push it away from himself to rotate the bed counterclockwise. As seen in FIGS. 7 and 8, the underside of turntable plate 40 is provided with inner and outer depending ears or tabs 80, 81 that are designed to engage and bear against a lever and spring operated latch bar 84. Latch bar 84 is spring loaded by spring 90 to pivot upward against the underside of turntable plate 40. When holder bed 30 is positioned by return spring 72 to the position shown in FIGS. 3 and 7, with lug 76 limiting the clockwise rotation of bed 30, turntable plate 40 has been rotated to the point where latch bar 84 is positioned outward of tab 81 (see FIGS. 5 and 7). When bed 30 is rotated counterclockwise to a position perpendicular to shaft 50, turntable plate 40 will be rotated so that latch bar 84 is positioned between tabs 80 and 81. Because latch bar 84 is spring-loaded upward by spring 90, latch bar 84 will contact the underside of plate 40 and bear against inner tab 81 and prevent further counterclockwise rotation of bed 30 beyond the perpendicular position. In the perpendicular position of bed 30 as shown in FIG. 8, latch bar 84 is positioned between tabs 80 and 81 a locks the bed 30 into the perpendicular position, with latch bar 84 bearing against outer tab 81. Bed 30 will remain locked in that position until latch bar 84 is pivoted downward, against the force of spring 90, out of contact with plate 40 and tab 81; and when so pivoted out of contact with tab 81, return spring 72 will rotate bed 30 back to the loading/unloading position of FIG. 3.

Figure 5:
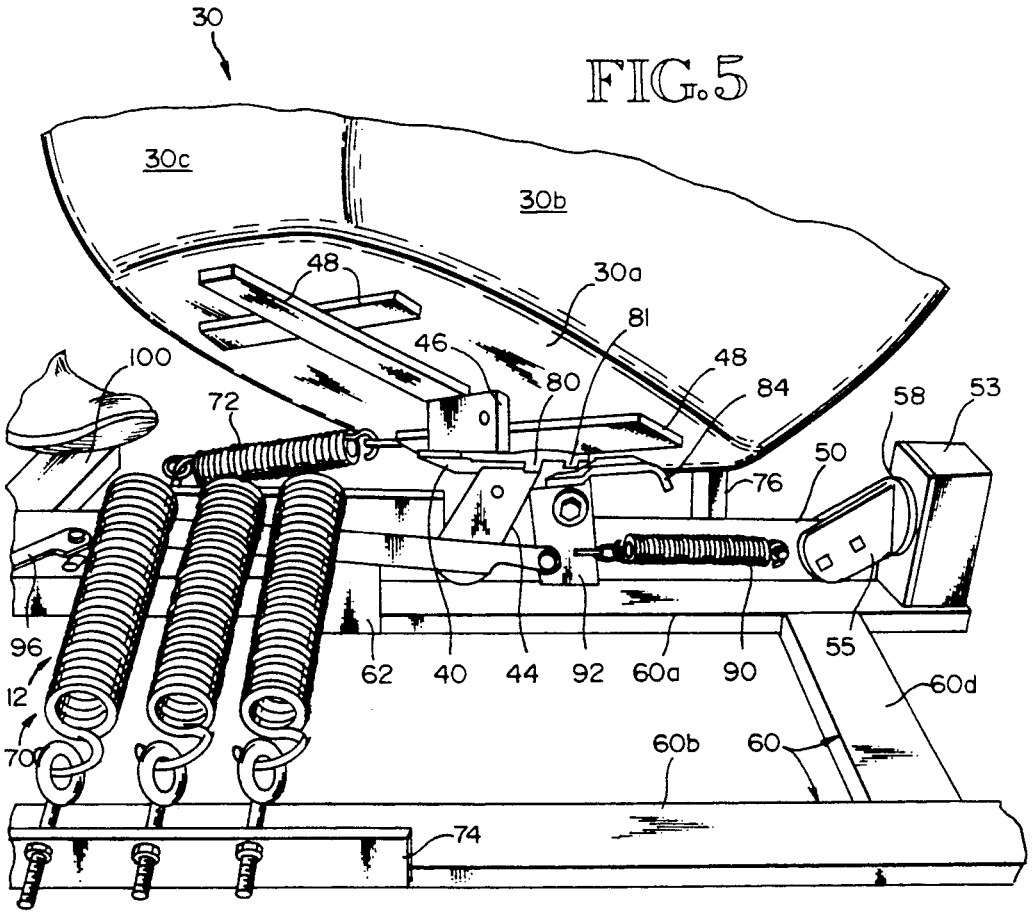
FIG. 5 is another partial view in elevation showing the same structure as FIG. 4, slightly enlarged, further illustrating the bed-positioning mechanism.

Latch bar 84 is mounted on a pivot plate 92 that is pivotally attached to the side of shaft 50, latch bar 84 being mounted to the pivot plate 92 above its pivot point. Spring 90 is anchored at one end to the rightward side of plate 92 and to shaft 50 as shown in FIGS. 5 and 8, below the pivot point. A link member 94 is pivotally attached to the leftward side of plate 92, also below the pivot point, and extends leftward along the inner side of shaft 50. A foot pedal 96 is pivotally mounted to that side of shaft 50 and is pivotally connected to the left end of link member 94 such that depressing the foot pedal 96 (thus rotating it counterclockwise when viewed as in FIG. 4) will pull the link member 94 leftward. Leftward movement of link member 94 will cause plate 92 to rotate clockwise (when viewed as in FIG. 4) and cause latch bar 84 to pivot downward out of contact with plate 40 and tabs 80 and 81, thereby releasing bed 30 for return to its loading/unloading position. Thus, foot pedal 96 acts as a trip lever which may be foot-operated by the operator-handler to cause the holder 10 to return to the position shown in FIG. 3 automatically.

Figure 3:
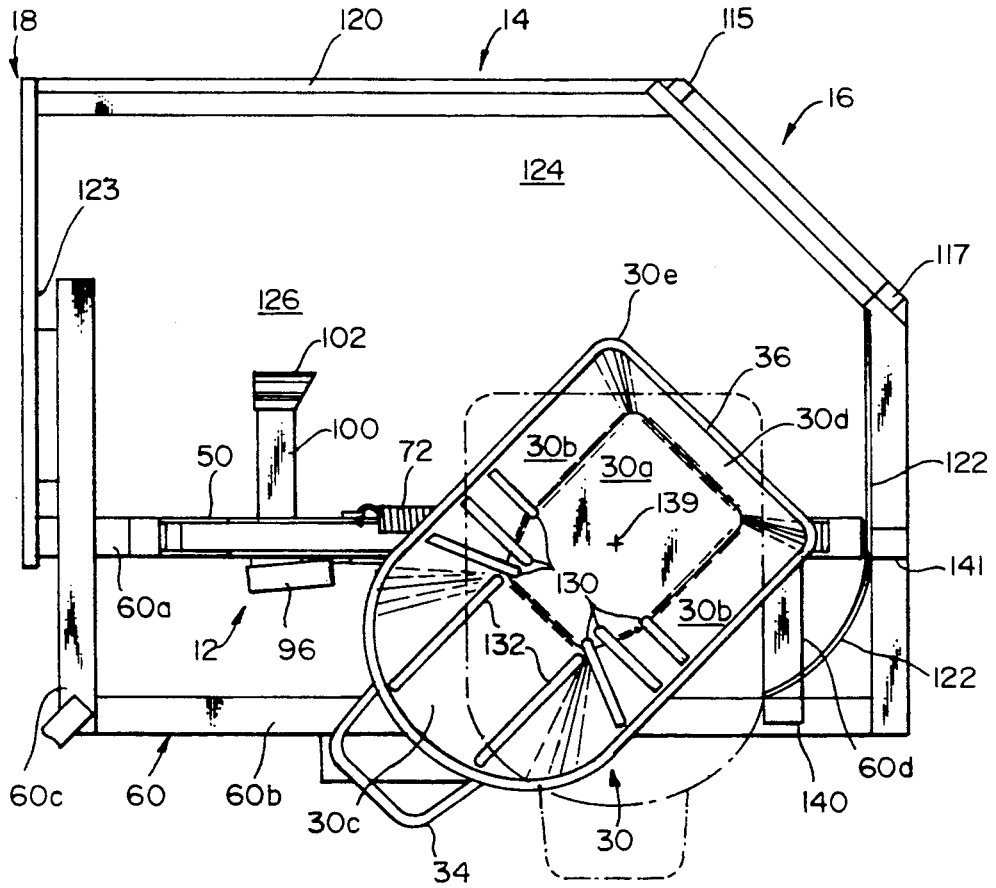
FIG. 3 is a plan view of the apparatus corresponding to the apparatus configuration shown in FIG. 2.

Shaft 50 may be rotated counterclockwise, as viewed from FIG. 6, by the operator-handler stepping on a pivot bar 100 mounted to the outer side of shaft 50 and extended perpendicularly outward toward the operator, as shown in FIG. 3. Bar 100 has a toe plate 102 at its outer end to help the operator surely step on the bar to rotate shaft 50 when desired. Bar 100, being located on the opposite side of shaft 50 from spring set 70, acts against the spring force of spring set 70. The cantilevered bar 100 is designed to be stepped on and forced downward toward the ground to rotate shaft 50 counterclockwise. This rotation of shaft 50 will cause holder 10 to tilt downward toward the ground from the position shown in FIG. 2 to the position shown in FIG. 1. With the bed 30 oriented in its loading/unloading position (as seen in FIG. 3), stepping on bar 100 will cause the bed 30 to tilt downward with the left edge **30*e* of the end wall 30*d*, the edge nearest the operator—hence the "near" edge, tilting closer to the ground than the right hand edge of the end wall 30*d*. Stop 64 and stop block 66 (see FIG. 6) will limit the downward tilting such that neither the "near" edge 30*e* nor the bed bottom 30*a* will actually contact the ground. When the foot bar 100 is released, the spring set 70 will cause the shaft 50 and holder 10** to rotate back to the normally upright position.

Compartment 14 is mounted to an extension of the base framework 60. The compartment comprises a sheep entry gate 116 for the doorway 16, a sheep exit gate 118 for the doorway 18, a side panel 120 connecting the two gates and a corner panel 122 between entry gate 116 and the right hand end of holder 10. An area 124 is provided in front of the holder 10 for sheep and an operator area 126 is provided to the left of the holder 10 for the operator to stand while operating the apparatus. Entry gate 116 is preferably aligned at an acute angle as shown in FIG. 3 so that an entering sheep will be directed toward the holder 10. Exit gate 118 is preferably aligned perpendicular as shown in FIG. 3 so that a sheep unloaded from the holder 10 will see the exit gate clearly and head for it directly. Entry gate 116 may be a guillotine-type gate which travels vertically in side tracks 115–117. A cord and pulley mechanism 119, including a pull-cord handle 121 may be installed so that the operator-handler may reach over and open the entry gate by pulling out and down on the pull-cord handle 121 to expose the doorway 16. Exit gate 118 may be a sliding-type gate which travels horizontally in top and bottom tracks 123, 125. A handle 127 may be installed so that the operator-handler may reach over and slide the exit gate open by gripping handle and pulling the gate sideways to expose the doorway 18.

The base frame 60 is preferably extended so as to mount the compartment panels 120, 122 and the gateway structures 115, 117 and 123, 125. In this configuration, the compartment 14, the holder means 10 and the holder positioning and mounting means 12 become a unitary structure that can be moved and relocated as a single unit. If desired, at some appropriate location such as at points 140, 141, three-point hitch-compatible connections could be mounted so that the entire unit could be attached to a farm tractor hitch, lifted clear of the ground and moved and relocated. Alternately, the various panels of the compartment could be separate constructions that would be assembled and pinned together for operation, and that could be unpinned and disassembled for relocation.

When a sheep is to be directed into the compartment 14, entry gate 116 would be opened and exit gate would remain closed. Thus, an entering sheep would head first toward the holder 10, since the location of entry gate 116 would promote this. Upon seeing the holder, however, an entering sheep would begin to turn toward the exit gate and attempt to proceed alongside panel 120. It would at this time that an operator-handler, who would be standing in his area 126 facing panel 120, would grasp the entering sheep with his left arm encircling the sheep's neck and his right hand gripping the sheep's "off", or right, rear hip. The operator-handler would then lift up with his left arm and pull up and in with his right hand. This combination of actions would cause the sheep to pivot on his "near", or left, hind foot back toward the holder 10. At this instant, the operator would step on foot bar 100 with his right foot to tilt the holder downward as described above. Since the "near" edge **30*a* of the bed 30 is tilted closer to the ground, the pivoting sheep's "near", or left, haunch will be brought into contact with the lowered "near" edge of the holder bed 30, causing the sheep to sit down and back into the holder bed. The operator-handler, having his left arm around the sheep's neck, will continue to carry the sheep back into the holder and, in effect, roll or bend the sheep back into the tilted holder bed until the sheep is lying down in the bed with its rump pressing against the bed end 30*d*. At this instant, the operator-handler takes his foot off bar 100 thereby permitting the bed 30 to be automatically uprighted to the FIG. 2 position, the spring force from spring set 70 causing the bed to abruptly right itself, which further aids in positioning the sheep into the position shown in FIG. 2. The pivoting motion that the sheep goes through as it is loaded into the tilted bed is very similar to the motion that a sheep-shearer would cause; but instead of the sheep being set down on its rump on the ground for shearing, the sheep finds itself set down on its rump on the end 30***d* of bed 30 and being pushed backward until its back is against the tilted bottom 30*a* of bed 30. From the time that an experienced operator-handler grasps an entering sheep until the sheep is loaded into the tilted-down bed 30 and foot bar 100 released to snap holder 10 upright, the total elapsed time would be on the order of 1–1½ seconds. The operator then grasps handle 34 and pushes it away from him to rotate the holder to its perpendicular examining/treating position. As the operator turns bed 30, latch bar 84 rides under outer tab 81 and snaps upward between tabs 80 and 81 to lock the holder into its perpendicular position for examining and treating the sheep. When the bed 30 is turned and latched into its perpendicular, examining/treating position, it assumes the position shown in dotted line in FIG. 3. As is evident from FIG. 3, this examining/treating position provides amply room for the handler to move around the bed 30 during examination and treatment. In particular, this examining/treating position permits the handler to stand at the foot of the bed 30, adjacent the bed end 30*d* when desired. Because the end extension 36 extends above the surrounding top edges of the bed side walls 30*b*, the haunches of a reclined sheep (as can be seen in FIG. 2) will contact this extension 36 to prevent the sheep from kicking out toward the handler. The swivel point 139, or rotation axis, for bed 30 is located at about the center of gravity for the holder means 10 when containing a reclined sheep; this center of gravity location being approximately at the center point of the bed bottom wall 30*a* as shown in FIG. 3.

The bed bottom wall 30*a*, being inclined downward when the bed assumes is upright position, causes a loaded sheep to assume a reclined position approximately the same as it would assume if a sheep-shearer had positioned the sheep on the ground and started the shearing process around the sheep's belly and hind legs. This is a comfortable position for a sheep and one in which the sheep will usually not fight or struggle to free itself The holder bed 30 is provided with several shoulder bars 130 that extend from the top edges of each of the bed side walls 30*b* down to the bottom wall 30*a*. These bars 130 are spaced from one another and curved inward and downward from the side walls 30*b* to the bottom wall 30*a*. When a sheep is loaded into the holder and reclined to the position shown in FIG. 2, the shoulder bars permit the sheep's shoulders to wedge between the bars. Because there are gaps between the bars 130, the sheep's thick wool coat will protrude into these gaps, between the bars, and help secure and stabilize the sheep in its reclined position. The holder bed 30 is also provided with a pair of neck bars 132 that extend from the top edge of the bed top wall 30*c* down to the bottom wall 30*a*. These neck bars 132 are spaced from one another and curved inward and downward from the top wall 30*c* to the bottom wall 30*a*. When a sheep is loaded into the holder and reclined to the position shown in FIG. 2, the neck bars permit the sheep's neck to wedge between the bars. The sheep's thick wool coat will protrude above and beneath these neck bars and help secure and stabilize the sheep in its reclined position. Sheep may be left unattended for short periods of time without risk and a single handler can easily examine and treat sheep contained within bed 30 without assistance.

When the operator is ready to unload the sheep from holder 10, he would open the exit gate 118 and then step across the shaft 50 with his right foot, and depress trip lever pedal 96 to release latch bar 84 to cause bed 30 to be rotated back to the loading/unloading position (the solid line position in FIG. 3). The operator-handler then steps on foot bar 100 to cause the bed 30 to tilt down with "near" edge 30*e* closest to the ground. While stepping on foot bar 100, the operator will guide the sheep out of the bed 30, the effect being as though the sheep is curled forward about its belly and out toward the "near" edge of the bed end 30*d*. The sheep will curl out of the bed and land on its front feet and stand up, its hind legs having naturally cleared the bed. The sheep then proceeds out of the compartment 14 through the exit gate 118. As the bed 30 is tilted down as a result of the operator stepping on foot bar 100, the sheep begins to lean forward and leftward—almost in a crumpling fashion—and naturally finds itself on its front feet alongside the holder 10. The momentum of this crumpling action gently propels the sheep forward out of the bed with enough energy that the sheep regains its hind feet with no slippage or struggle. Sheep that leave this apparatus and enter immediately into a field will begin grazing only a few feet from the compartment—a good indication that the handling and manipulation involved in loading and unloading does not stress the sheep.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A sheep handling system comprising sheep holding means and sheep holder positioning and mounting means, said sheep holding means comprising a sheep-holding bed adapted to receive and hold a sheep, said sheep-holding bed having two side walls, a head-end wall and a foot-end wall, one side wall thereof being joined to the end wall at a near corner and the other side wall thereof being joined to the end wall at a far corner; and said sheep holder positioning and mounting means comprising a base, swivel means providing a swivel axis to enable said sheep-holding bed to be swiveled about said swivel axis from a first position to a second sheep examining/treating position, tilting means providing a generally horizontally-oriented tilting axis to enable said sheep-holding bed to be tilted about said tilting axis between an inclined sheep loading/unloading attitude and an upright attitude; said swivel means and said tilting means being so constructed and arranged with respect to one another whereby said sheep-holding bed may be positioned at said first position and tilted about said tilting axis to an inclined sheep loading/unloading attitude, whereat a sheep can be placed in said bed, and said bed then tilted about said tilting axis to an upright attitude and swiveled about said swivel axis from said first position to said second sheep examining/treating position; said sheep holder positioning and mounting means further comprising first positioning means for releasably-positioning said sheep-holding bed in said upright attitude and second positioning means for releasably-positioning said sheep-holding bed in said first position, said second positioning means being so constructed and arranged with respect to said swivel means and said tilting means to orient said sheep-holding bed at an acute angle relative to said tilting axis when it assumes said first position whereby the bed near corner will be located further from said tilting axis than the bed far corner, and whereby tilting said sheep-holding bed about said tilting axis from said upright attitude to said inclined sheep loading/unloading attitude will cause said sheep-holding bed near corner to tip closer to the ground than the bed far corner.

2. The system of claim 1 wherein said sheep holder positioning and mounting means includes means to mount said sheep-holding bed at an incline with respect to said base whereby said bed is inclined when positioned in said upright attitude.

3. The system of claim 1 wherein said second positioning means includes latching means for locking said sheep-holding bed in said sheep examining/treating position and a foot-operated mechanism for releasing said latching means whereby said bed may be returned to said first position.

4. The system of claim 1 wherein said tilting means includes a foot-operated mechanism for tilting said sheep-holding bed to said sheep loading/unloading attitude.

5. The sheep handling system of claim 1 wherein said sheep holding means comprises a pair of shoulder bar sets, each set including several shoulder bars located within said sheep-holding bed and attached to the bed side and bottom walls, the shoulder bars of each set being so spaced from one another whereby the wool coat of a sheep contained within said bed will extend between the shoulder bars to help secure and stabilize the sheep.

6. The sheep handling system of claim 1 wherein said sheep holding means includes a pair of neck bars located within said sheep-holding bed and attached to the bed head-end and bottom walls and so spaced from one another whereby the neck of a sheep contained within said bed will be wedged between the neck bars with its wool coat extending around the neck bars to help secure and stabilize the sheep.

7. A sheep handling system comprising sheep holding means and sheep holder positioning and mounting means, said sheep holding means comprising a sheep-holding bed adapted to receive and hold a sheep; and said sheep holder positioning and mounting means comprising a base, swivel means mounting said sheep-holding bed and providing a swivel axis to enable said sheep-holding bed to be swiveled about said swivel axis from a first position to a second sheep examining/treating position, tilting means mounting said swivel means from said base and providing a generally horizontally-oriented tilting axis to enable said sheep-holding bed to be tilted about said tilting axis between an inclined sheep loading/unloading attitude and an upright attitude; said swivel means and said tilting means being so constructed and arranged with respect to one another whereby said sheep-holding bed may be positioned at said first position and tilted about said tilting axis to an inclined sheep loading/unloading attitude, whereat a sheep can be placed in said bed, and said bed then tilted about said tilting axis to an upright attitude and swiveled about said swivel axis from said first position to said second sheep examining/treating position; said sheep holder positioning and mounting means further comprising first positioning means for releasably-positioning said sheep-holding bed in said upright attitude and second positioning means for releasably-positioning said sheep-holding bed at said first position, said first positioning means being so constructed and arranged with respect to said swivel means and said tilting means whereby said swivel axis is generally vertically-oriented when said sheep-holding bed assumes said upright attitude; said sheep holder positioning and mounting means further including means to mount said sheep-holding bed at an incline with respect to said base whereby said bed is inclined when positioned in said upright position; said second positioning means including latching means for locking said sheep-holding bed in said sheep examining/treating position and a foot-operated mechanism for releasing said latching means whereby said bed may be returned to said first position.

8. The sheep handling system of claim 7 wherein said sheep holding means comprises a pair of shoulder bar sets, each set including several shoulder bars located within said sheep-holding bed and attached to the bed side and bottom walls, the shoulder bars of each set being so spaced from one another whereby the wool coat of a sheep contained within said bed will extend between the shoulder bars to help secure and stabilize the sheep.

9. The sheep handling system of claim 7 wherein said sheep holding means includes a pair of neck bars located within said sheep-holding bed and attached to the bed head-end and bottom walls and so spaced from one another whereby the neck of a sheep contained within said bed will be wedged between the neck bars with its wool coat extending around the neck bars to help secure and stabilize the sheep.

10. A method of positioning a sheep for examination and or treatment comprising the steps of providing a sheep-holding bed having sides, a bottom and an end; orienting the bed end downward with one end corner tipped closer to the ground than the other end corner; grasping a sheep and turning it about its near hind foot over the lowermost end corner and into the inclined sheep-holding bed; reclining the sheep into the sheep-holding bed with its rump supported within said bed by the bed bottom and end; reorienting the sheep-containing bed by tilting the bed about a generally horizontal tilting axis to an upright position at which the bed bottom remains inclined wherein the sheep remains inclined from had to feet; and swiveling the sheep-containing bed about a generally vertical swivel axis to an examining/treating position wherein the sheep remains inclined from head to feet with its rump supported within the sheep-holding bed by the bed end.

11. A sheep handling system comprising sheep holding means and sheep holder positioning and mounting means, said sheep holding means comprising a sheep-holding bed adapted to receive and hold a sheep; and said sheep holder positioning and mounting means comprising a base, swivel means mounting said sheep-holding bed and providing a swivel axis to enable said sheep-holding bed to be swiveled about said swivel axis from a first position to a second sheep examining/treating position, tilting means mounting said swivel means from said base and providing a generally horizontally-oriented tilting axis to enable said sheep-holding bed to be tilted about said tilting axis between an inclined sheep loading/unloading attitude and an upright attitude; said swivel means and said tilting means being so constructed and arranged with respect to one another whereby said sheep-holding bed may be positioned at said first position and tilted about said tilting axis to an inclined sheep loading/unloading attitude, whereat a sheep can be placed in said bed, and said bed then tilted about said tilting axis to an upright attitude and swiveled about said swivel axis from said first position to said second sheep examining/treating position; said sheep holder positioning and mounting means further comprising first positioning means for releasably-positioning said sheep-holding bed in said upright attitude and second positioning means for releasably-positioning said sheep-holding bed at said first position, said first positioning means being so constructed and arranged with respect to said swivel means and said tilting means whereby said swivel axis is generally vertically-oriented when said sheep-holding bed assumes said upright attitude.

12. A sheep handling system comprising sheep holding means and sheep holder positioning and mounting means, said sheep holding means being mounted by said sheep holding positioning and mounting means close enough to the ground whereby a sheep may be laid into said sheep holding means by pivoting it about one of its hind feet from a standing position alongside said sheep holding means to a reclining position within said sheep holding means, said sheep holding means comprising a sheep-holding bed adapted to receive and hold a sheep; and said sheep holder positioning and mounting means comprising a base, swivel means providing a swivel axis to enable said sheep-holding bed to be swiveled about said swivel axis from a first position to a second sheep examining/treating position, tilting means providing a generally horizontally-oriented tilting axis to enable said sheep-holding bed to be tilted about said tilting axis between an inclined sheep loading/unloading attitude and an upright attitude; said swivel means and said tilting means being so constructed and arranged with respect to one another whereby said sheep-holding bed may be positioned at said first position and tilted about said tilting axis to an inclined sheep loading/unloading attitude close to the ground, whereat a sheep can be placed in said bed by pivoting the sheep about one of its hind feet from a standing position alongside said bed to a reclining position within said bed, and said bed then tilted about said tilting axis to an upright attitude and swiveled about said swivel axis from said first position to said second sheep examining/treating position; said base comprising a frame having a coplanar configuration broad enough to support said sheep holder positioning and mounting means close to the ground whereby said sheep holding means clears the ground by a short distance.

13. The system of claim 12 wherein said sheep holder positioning and mounting means includes means to mount said sheep-holding bed at an incline with respect to said base whereby said bed is inclined when positioned in said upright attitude.

14. The system of claim 12 wherein said sheep holder positioning and mounting means comprises latching means for locking said sheep-holding bed in said sheep examining/treating position and a foot-operated mechanism for releasing said latching means whereby said bed may be returned to said first position.

15. The sheep handling system of claim 12 wherein said sheep holding means comprises a pair of shoulder bar sets, each set including several shoulder bars located within said sheep-holding bed and attached to the bed side and bottom walls, the shoulder bars of each set being so spaced from one another whereby the wool coat of a sheep contained within said bed will extend between the shoulder bars to help secure and stabilize the sheep.

16. The sheep handling system of claim 12 wherein said sheep holding means includes a pair of neck bars located within said sheep-holding bed and attached to the bed head-end and bottom walls and so spaced from one another whereby the neck of a sheep container within said bed will be wedged between the neck bars with its wool coat extending around the neck bars to help secure and stabilize the sheep.

* * * * *